US012662794B2

(12) United States Patent
Davies

(10) Patent No.: US 12,662,794 B2
(45) Date of Patent: Jun. 23, 2026

(54) EARTH SCRAPER

(71) Applicant: Ian Davies, Hamilton (NZ)

(72) Inventor: Ian Davies, Hamilton (NZ)

( * ) Notice: Subject to any disclaimer, the term of this patent is extended or adjusted under 35 U.S.C. 154(b) by 446 days.

(21) Appl. No.: 18/039,808

(22) PCT Filed: Dec. 1, 2021

(86) PCT No.: PCT/NZ2021/050213
§ 371 (c)(1),
(2) Date: Jun. 1, 2023

(87) PCT Pub. No.: WO2022/119457
PCT Pub. Date: Jun. 9, 2022

(65) Prior Publication Data

US 2024/0093462 A1 Mar. 21, 2024

(30) Foreign Application Priority Data

Dec. 1, 2020 (NZ) ..... 770551
Oct. 14, 2021 (AU) ..... 2021903296

(51) Int. Cl.
*E02F 3/64* (2006.01)
*E02F 3/65* (2006.01)

(52) U.S. Cl.
CPC ..... *E02F 3/6472* (2013.01); *E02F 3/651* (2013.01); *E02F 3/652* (2013.01)

(58) Field of Classification Search
CPC ..... E02F 3/6472; E02F 3/651; E02F 3/652; E02F 3/655; E02F 3/657; E02F 3/6454; E02F 3/649; E02F 3/6481
See application file for complete search history.

(56) References Cited

U.S. PATENT DOCUMENTS

| | | | | | |
|---|---|---|---|---|---|
| 895,631 | A | | 8/1908 | Haase | |
| 2,203,713 | A | | 6/1940 | Watson | |
| 3,052,996 | A | | 9/1962 | Holopainen | |
| 3,225,850 | A | * | 12/1965 | Simmons | E02F 3/652 280/406.1 |
| 3,445,946 | A | | 5/1969 | Striggow | |
| 3,475,841 | A | * | 11/1969 | Delfino | E02F 3/64 37/447 |
| 3,584,403 | A | * | 6/1971 | Copeland | E02F 3/64 37/201 |
| 3,584,405 | A | * | 6/1971 | Mazzarins | E02F 3/64 37/417 |
| 3,589,041 | A | | 6/1971 | Anderson et al. | |
| 3,945,519 | A | * | 3/1976 | Eriksson | E02F 3/6418 414/812 |
| 10,407,866 | B2 | * | 9/2019 | Mononen | E02F 3/402 |
| 2017/0306589 | A1 | * | 10/2017 | Ge | E02F 9/2095 |
| 2018/0066680 | A1 | * | 3/2018 | Robson | E02D 7/10 |

FOREIGN PATENT DOCUMENTS

SU 1077994 3/1984

* cited by examiner

*Primary Examiner* — Christopher J Sebesta
*Assistant Examiner* — Evan A Bregel
(74) *Attorney, Agent, or Firm* — Levine Bagade Han LLP

(57) ABSTRACT

Described is an earth scraper including multiple buckets to receive earth scraped by a scraper blade. A lifter mechanism is provided to move one of the buckets between elevated and lowered positions.

21 Claims, 13 Drawing Sheets

EARTH SCRAPER

CROSS-REFERENCE TO RELATED APPLICATIONS

This application is a U.S. national phase under 35 U.S.C. 371 of International Patent Application Number PCT/NZ2021/050213 filed Dec. 1, 2021, which claims priority to Australian Patent Application Number AU 2021903296 filed Oct. 14, 2021 and New Zealand Application Number NZ 770551 filed Dec. 1, 2020, the contents of which are incorporated herein by reference in their entireties.

FIELD OF INVENTION

This invention relates to an earth scraper, for example a double decker earth scraper.

BACKGROUND

It is known in the field of earthworks for a tractor unit to tow a scraper blade across the ground to scrape earth up into a container. The scraper may therefore be used to remove earth from a worksite under development. A problem with many known scrapers is that as the earth builds up in the container, especially near the entrance, it becomes progressively more difficult to get further earth into the container. Accordingly, the tractor has to exert significantly more towing force to keep earth moving into the container. As a result the scraping process can become inefficient.

OBJECT

It is an object of preferred embodiments of the invention go at least some way towards addressing the above problem. While this applies to preferred embodiments, it should be understood that the object of the invention per se is more general. It is simply to provide the public with a useful choice.

Definitions

The terms 'comprise' or 'has', as used in this document in relation to one or more features, should be understood to mean that the named features are the minimum present. There may or may not be other features. The same applies to terms such as 'comprising' and 'having'.

The term "earth" is used in this document to indicate the nature of material being scraped from the ground. Normally this will comprise soil, sand, clay, gravel, rocks or any combination of any of these, but the term should not be seen as limited to such material. It may optionally encompass material scraped from the ground such as salt, lime or minerals, etc.

SUMMARY OF THE INVENTION

According to one aspect, the invention is a scraper comprising a container, a lifter and a blade, the container having a lower floor and an upper floor, the scraper being formed such that:

- the blade is arranged to scrape earth from the ground so the earth moves into the container and onto the upper floor; and
- the lifter is able to elevate the upper floor when loaded with scraped earth to create a space between the two floors such that further earth scraped by the scraper enters and is retained in that space.

Optionally, the lifter is configured to move the upper floor upwardly and rearwardly to create a space between the two floors.

Optionally the struts guide the upper floor through an arcuate path between an elevated position and a lowered position.

Optionally, the lifter is configured to move the upper floor to an elevated position in which a centre of mass of material (e.g. earth) on the upper floor is substantially above ground engaging wheels or tracks which support the support frame.

Optionally the lifter comprises a series of struts arranged to guide the upper floor upwards to create the space between the two floors.

Optionally the upper floor lays on top of the lower floor until the upper floor is elevated by the lifter.

According to a further aspect, the invention is a scraper comprising:

- a container;
- at least one blade adapted for scraping earth into the container;
- at least a ground engaging wheel or track by which the scraper is moved over the earth when towed; and
- optionally a drive shaft adapted to be coupled to and given rotational motion by a towing vehicle (e.g. a tractor) to drive the wheel or track and, as a consequence the scraper, over the earth while the blade scrapes the earth into the container.

Optionally the scraper has at least a pair of ground engaging wheels or tracks that enable the scraper to be towed.

Optionally the container comprises subdivisions or separated pans.

Optionally the drive shaft extends along a space between the pans.

Optionally the drive shaft is coupled to a differential, which is in turn connected to an axle, the axle in turn being connected to wheels or tracks for facilitating towing of the scraper.

Optionally the axle comprises two sub axles, one either side of the differential.

Optionally the blade comprises separate sub-blades.

Optionally the scraper comprises a structural frame.

Optionally the container is mounted to the structural frame.

Optionally the structural frame comprises detachable sub-frames.

Optionally the scraper comprises at least one ground engaging wheel or track to support the scraper on ground.

Optionally the scraper comprises at least one actuator to move the scraper between a lifted configuration and a scraping mode.

Optionally, the actuator to move the scraper between the lifted configuration and the scraping mode comprises a hydraulic actuator and ram.

Optionally the lifter comprises at least one actuator to move the upper floor between the elevated position and the lowered position.

Optionally the container has an apron (e.g. a gate) that can close and subsequently open to facilitate retention and dumping of earth.

Optionally the scraper comprises a draw bar adapted to swing about a pivot connection so that a distal end of the draw bar can be aligned with the centre of the combination of the sub-frames when the sub-frames are attached to one another, and subsequently aligned with the centre of one of the sub frames that it swings about when the sub-frames are detached from one another.

Optionally for either aspect above, the scraper comprises an accumulator that stores energy from the tractor unit that tows it and uses that energy to at least assist in raising the upper floor when laden with scraped earth.

Optionally the accumulator is built into a structural frame of the scraper that supports the container or a pan thereof.

Optionally the accumulator comprises a gas filled bladder adapted to be compressed by hydraulic fluid for storing energy, and subsequently decompressed to release energy.

Optionally the accumulator has an internal compartment housing the bladder, hydraulic fluid and an outlet for the fluid when under pressure, the bladder being separated from the outlet by a permeable barrier.

Optionally the drive shaft extends within a raised section of a lower floor of the container and is higher than the lowermost interior surface of that floor.

Optionally the scraper comprises an apron (e.g. a gate) that can be moved to a closed position to substantially prevent earth from spilling out of the container when loaded and in transit.

Optionally the apron is such that it can be moved to a position against the blade by way of force obtained from a wheel lift assembly via the drive shaft.

DRAWINGS

Some preferred embodiments of the invention will now be described by way of example and with reference to the accompanying drawings, of which—

Figure 9:
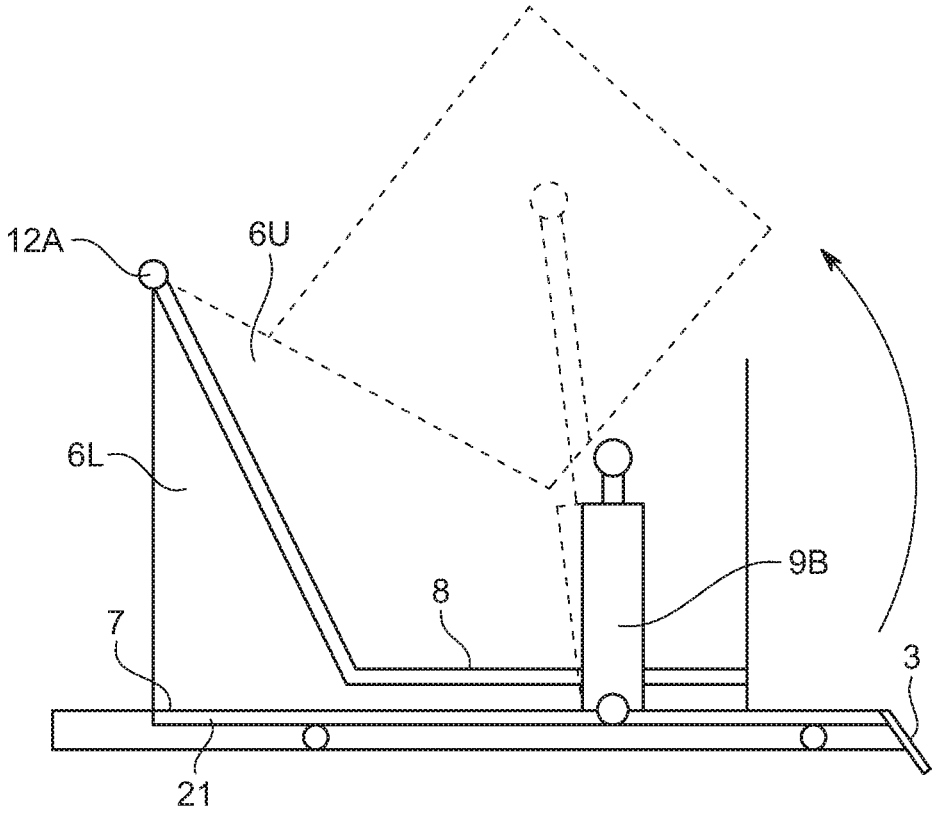
Figure 10:
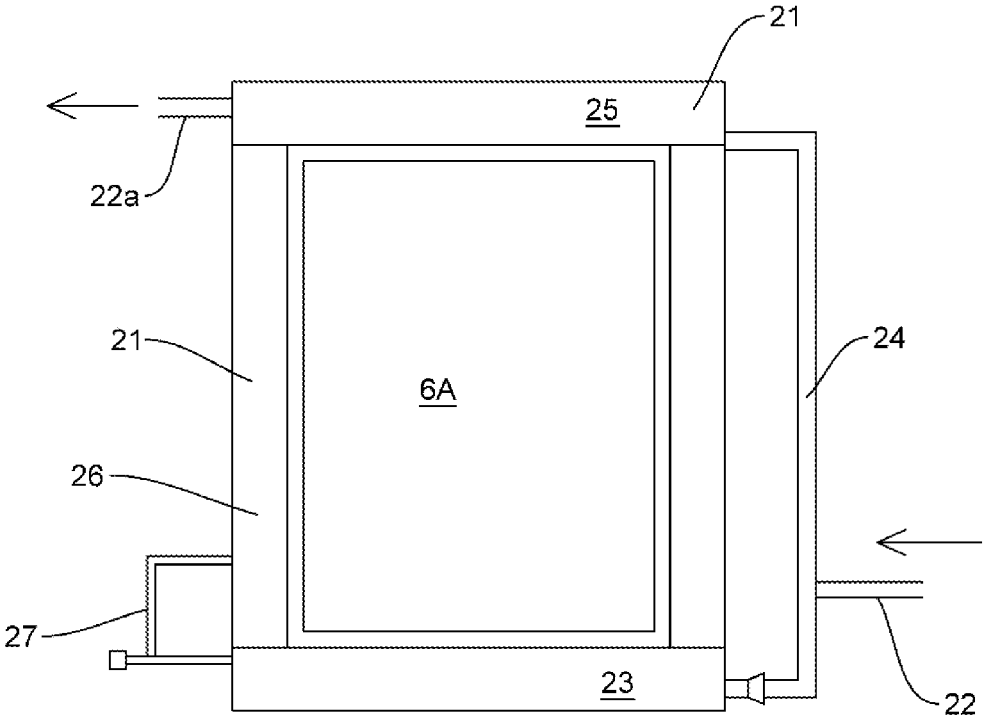
Figure 11:
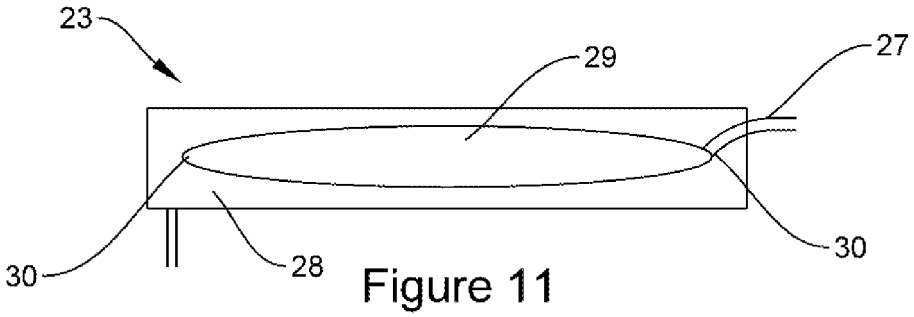
Figure 12:
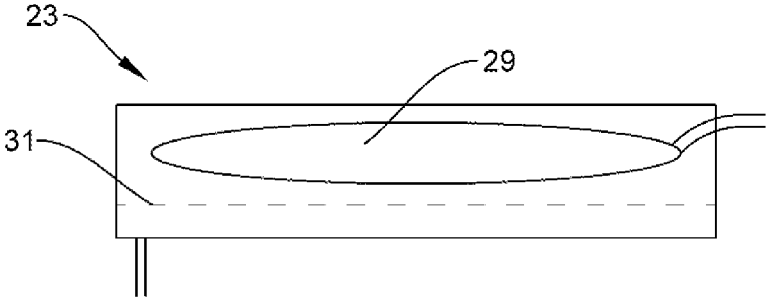
Figure 13:
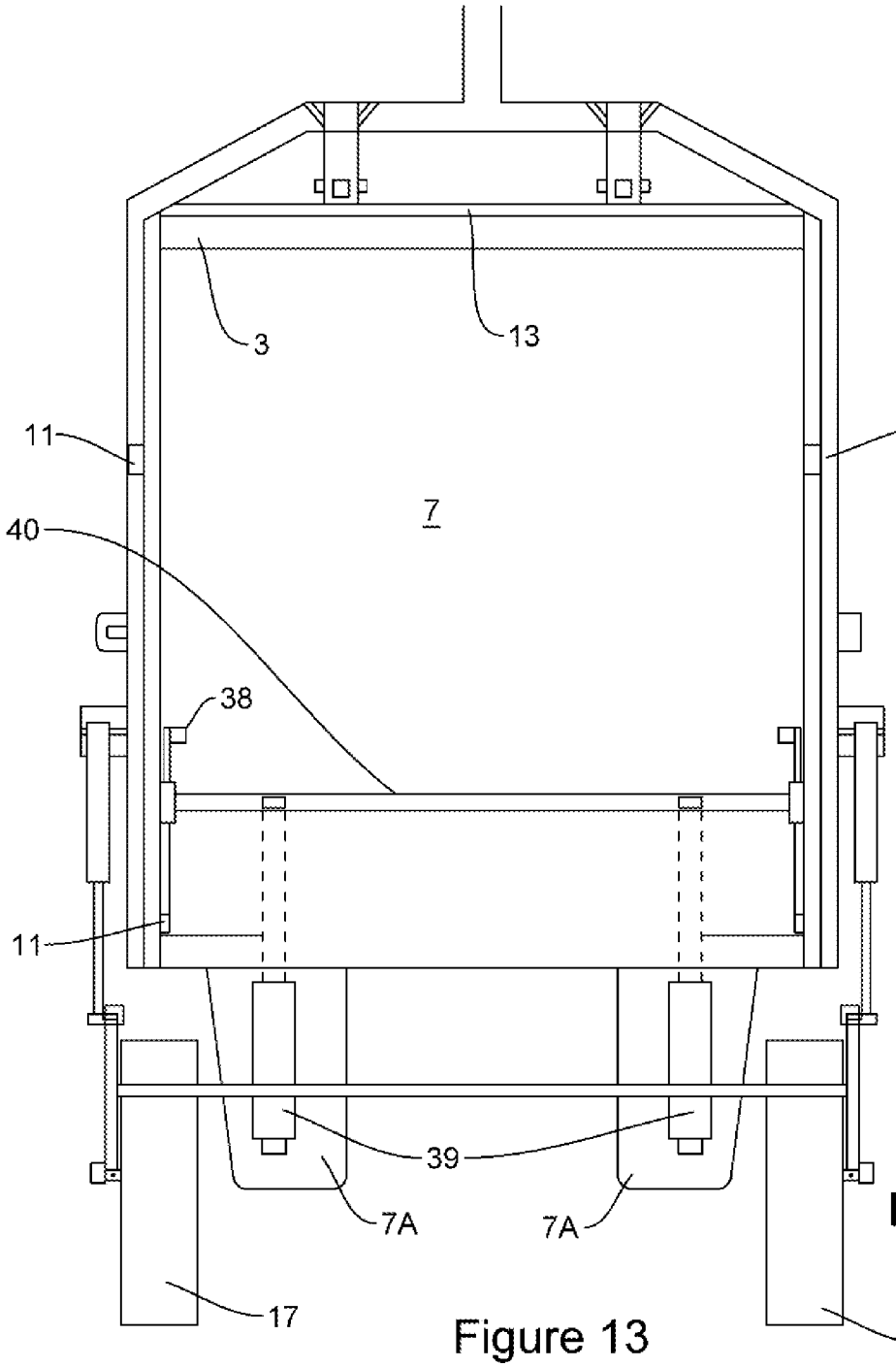
Figure 14:
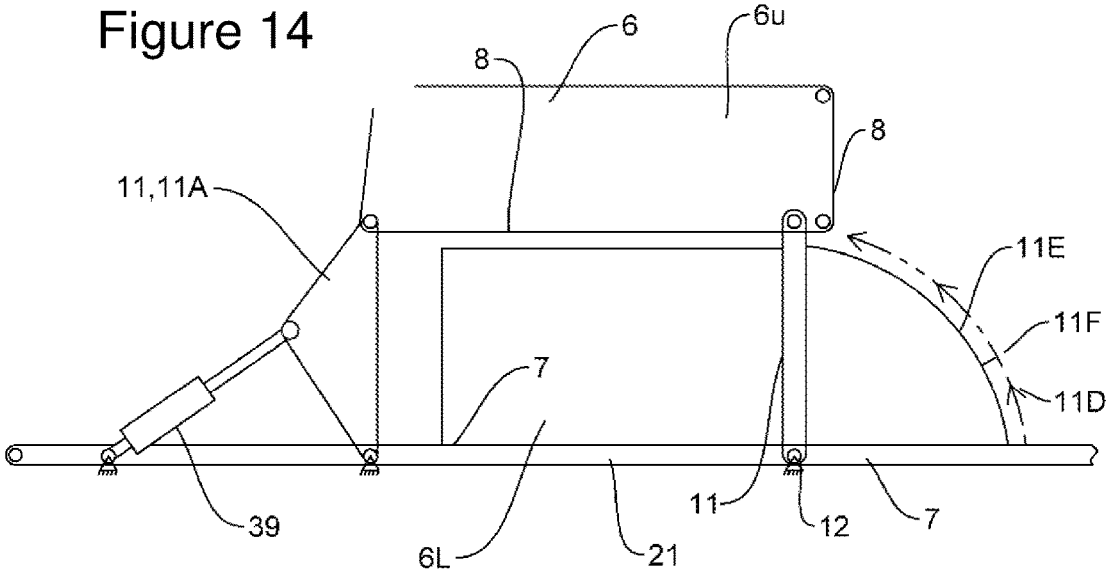
Figure 15:
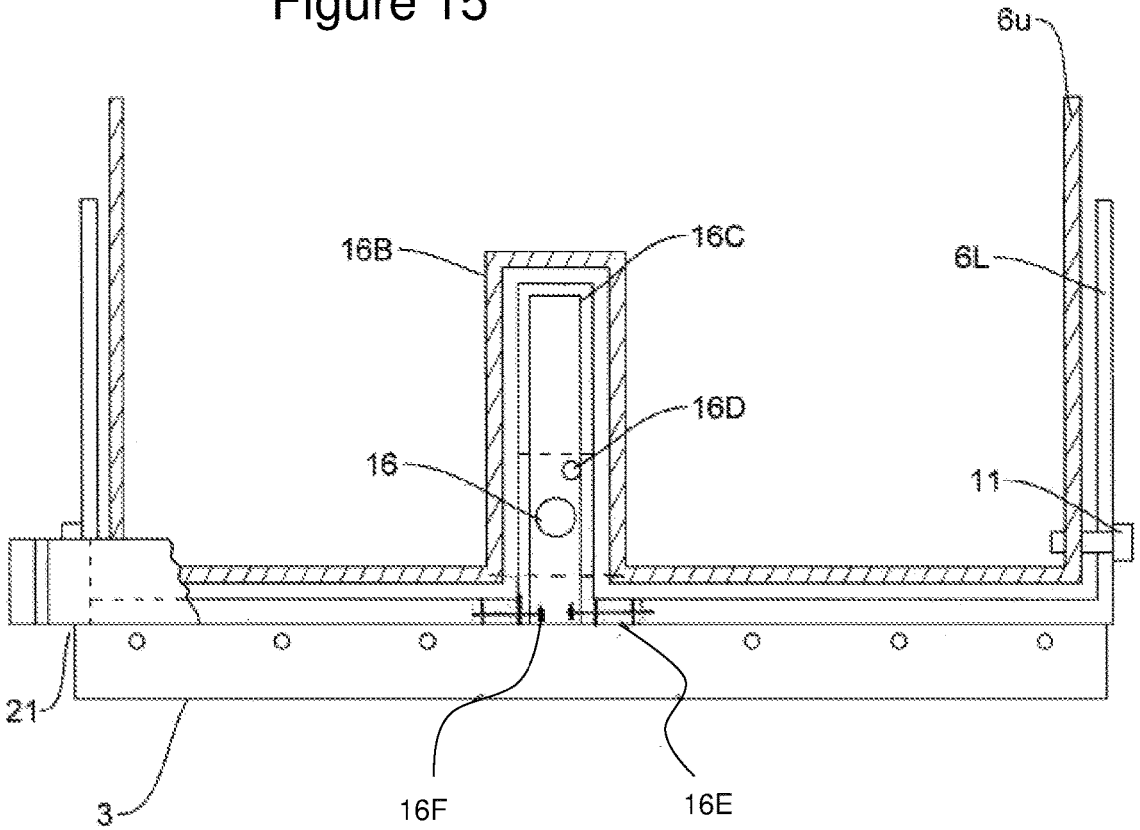
Figure 16:
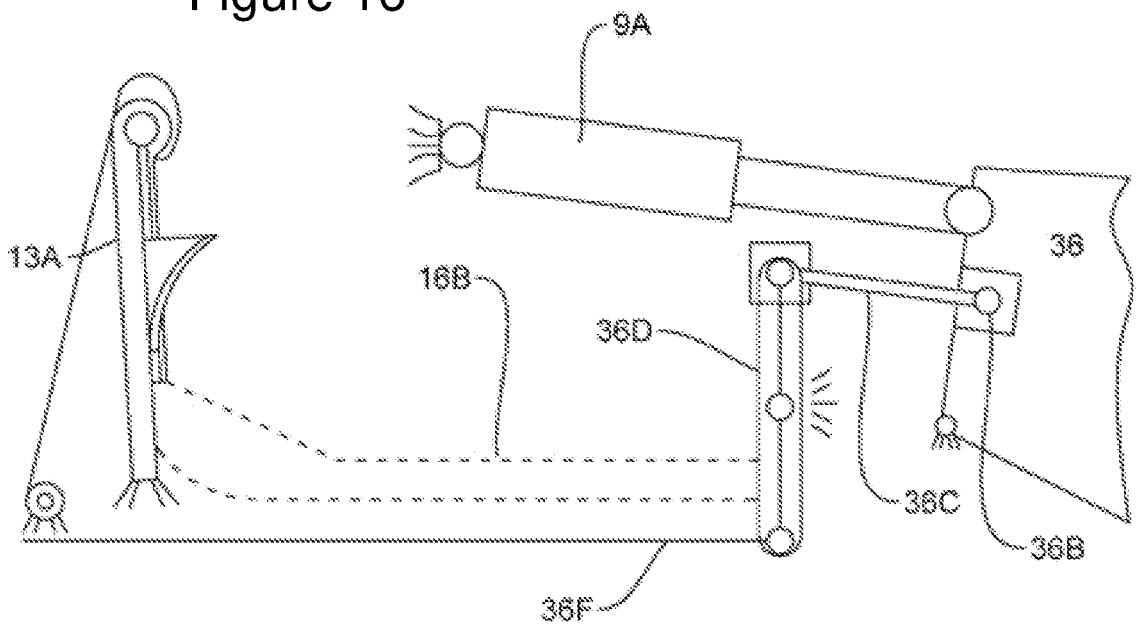
Figure 17:
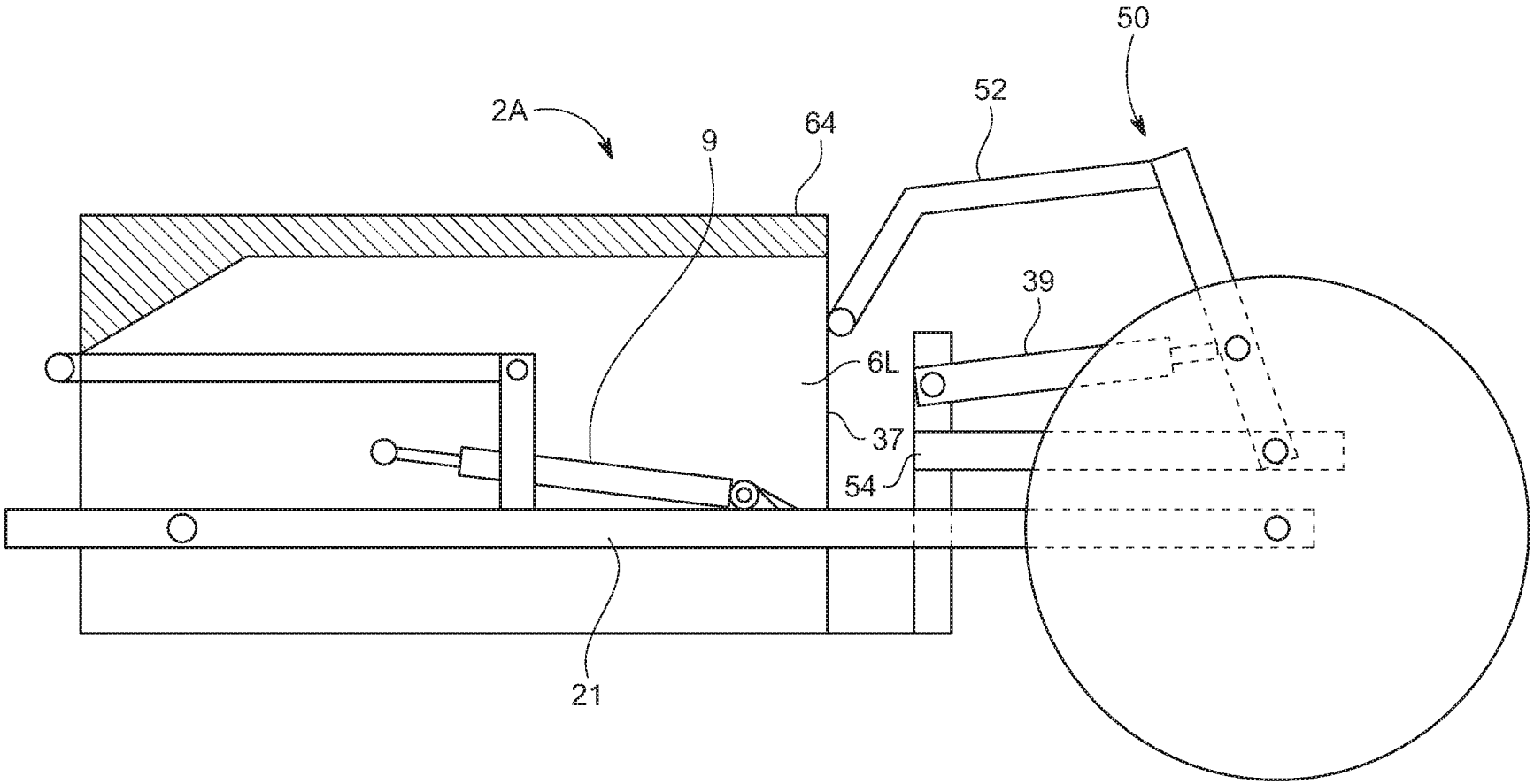
Figure 18:
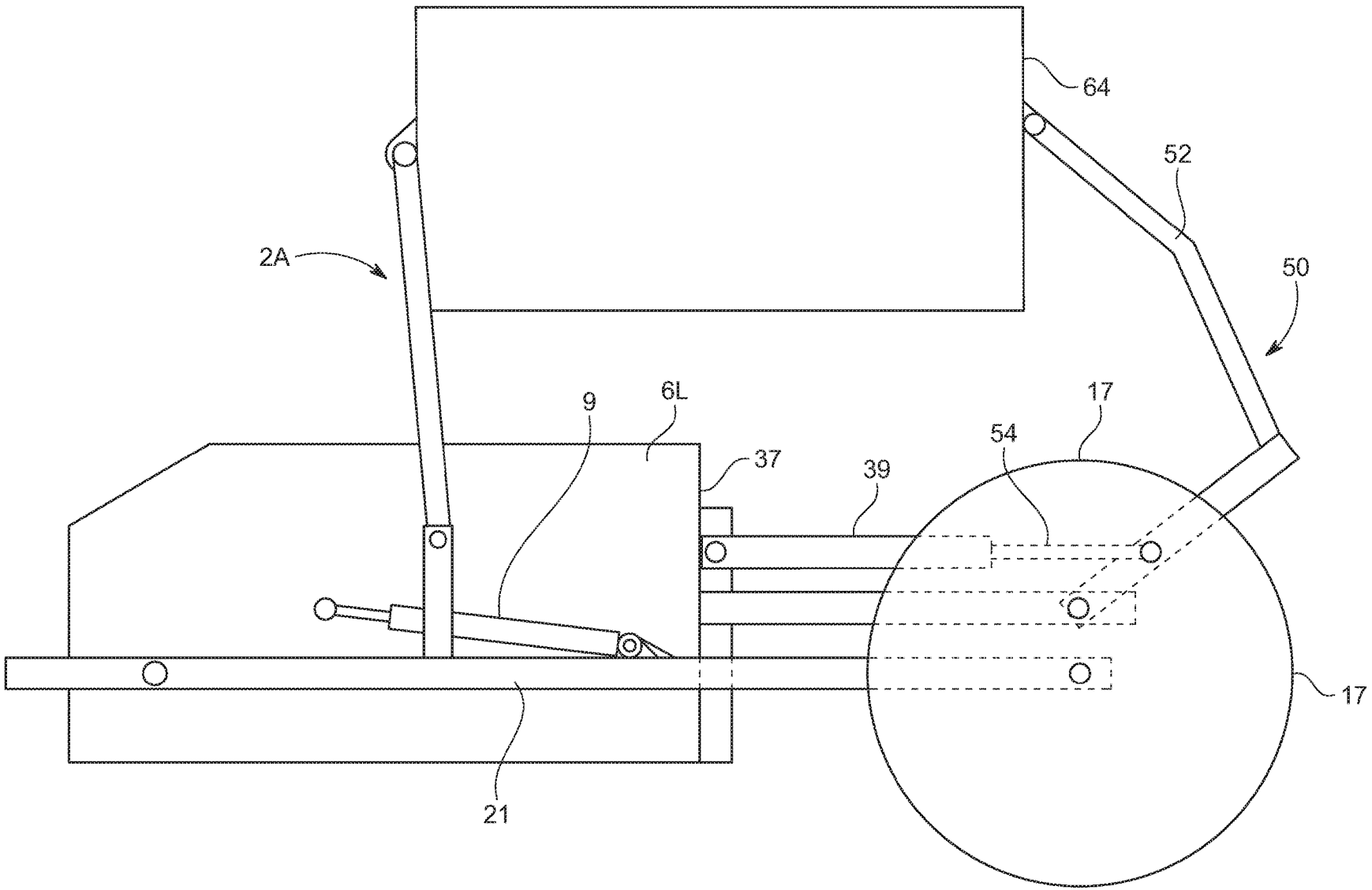
Figure 19:
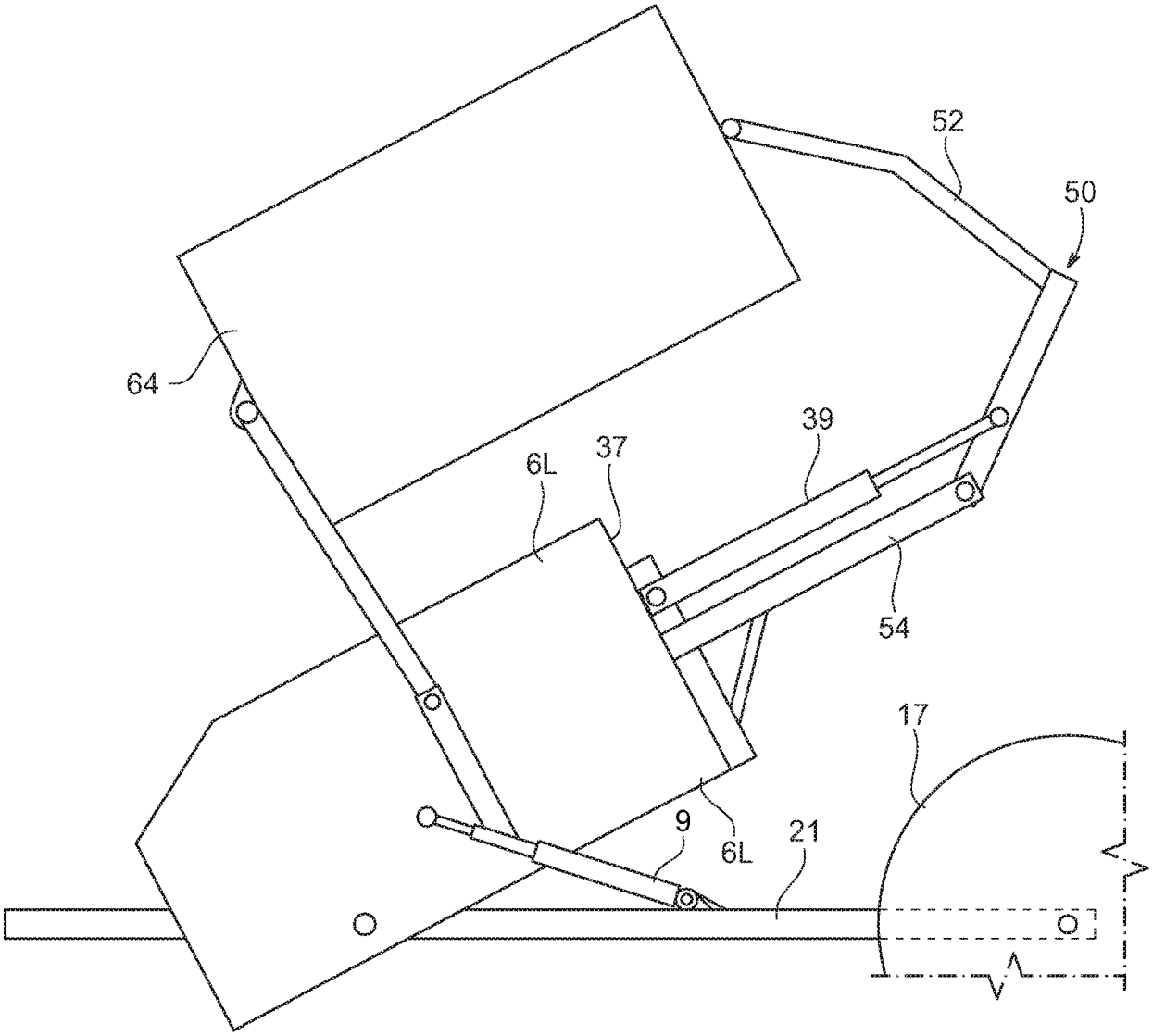

FIG. 9 schematically illustrates a similar scraper to those above, but with an alternative mechanism for raising the upper compartment of the container;

FIG. 10 illustrates an accumulator and related components that may form part of any of the scrapers above;

FIG. 11 schematically illustrates internal detail of the accumulator;

FIG. 12 schematically illustrates internal detail of a modified version of the accumulator;

FIG. 13 is a schematic plan view of a similar but alternative scraper showing a slightly different configuration of the parts;

FIG. 14 is a side view showing certain components of the FIG. 13 scraper with its upper compartment 6U elevated;

FIG. 15 is a transverse cross section view through the scraper, showing detail of its container;

FIG. 16 shows detail of a mechanism by which the scraper can be moved to a lowered position and at the same time open an apron at the front end of the scraper;

FIG. 17 shows a scraper with an alternate embodiment for a mechanism and actuator;

FIG. 18 shows the arrangement of FIG. 17 with the upper compartment in aa raised position; and FIG. 19 shows the arrangement of FIG. 17 with the upper compartment and the lower compartment tilted to dump earth therefrom.

DETAILED DESCRIPTION

Floor Raising Features

Figure 1:
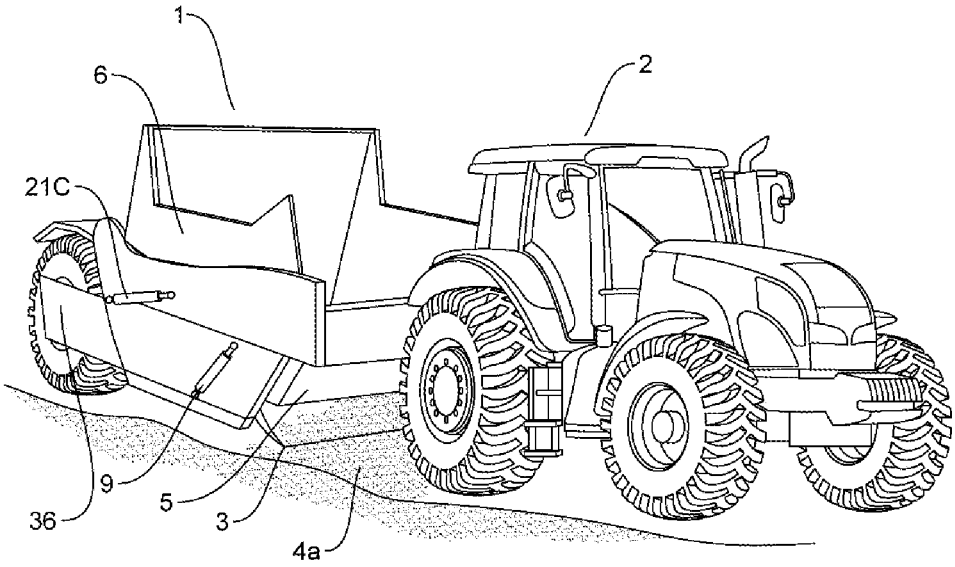
FIG. 1 illustrates an earth scraper being towed by a tractor unit.

Referring to FIG. 1, the scraper 1 is towed over the surface of a work site by a prime mover such as a tractor unit 2 illustrated. As it is towed a blade 3 cuts into the ground 4 and causes earth 4*a* to be scraped up and move through an entrance 5 into a container 6. The tractor unit 2 is shown in FIG. 1 with wheels (unlabelled) for driving over the ground, but in other examples it may be substituted by alternative towing apparatus, for example a vehicle with tracks. In some embodiments the prime mover may be in the form of a truck or other vehicle suitable for towing the scraper 1.

The scraper 1 has a support frame 21 and at least one wheel e.g. two wheels 17 as illustrated. The lower compartment 6L is mounted to the support frame 21.

The scraper 1 has a forward end being the end of the support frame 21 at or towards which the blade 3 is mounted and which is the leading end of the scraper 2 in its normal operation e.g. when scraping earth. The scraper 2 also has a rear end being the trailing end of the support frame 21 in its normal operation.

Figure 2:
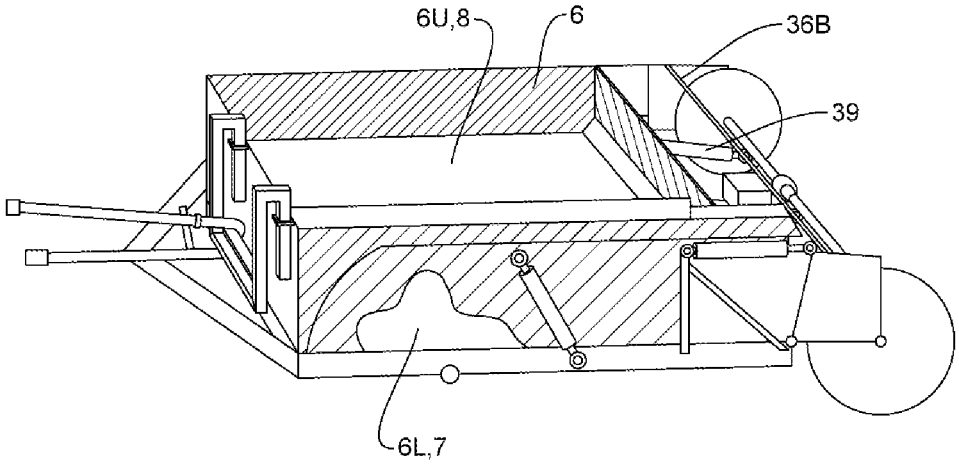
FIG. 2 is an isometric view of the of the scraper.

As shown in FIG. 2, the container 6 has a lower compartment 6L having a lower floor 7 and an upper compartment 6U that has an upper floor 8. Initially the upper floor 8 is lowered to sit on or be slightly above the lower floor 7. The arrangement is such that earth scraped into the container 6 by the blade 3 via the entrance 5 collects on the upper floor 8.

Figure 3:
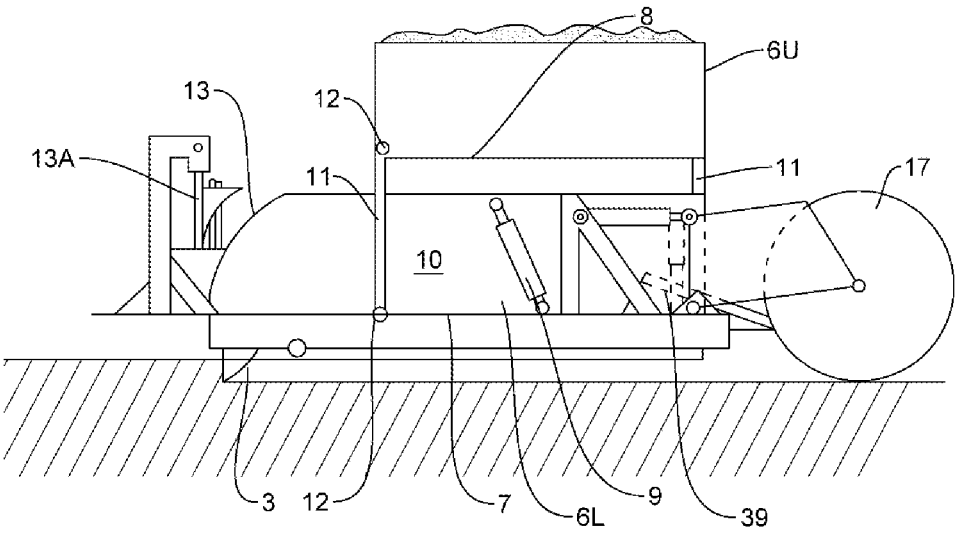
FIG. 3 is a side view illustrating the scraper with its upper container compartment elevated.

Referring to FIG. 3, when the upper compartment 6U is sufficiently filled with earth, an actuator 39 is activated to raise the upper compartment 6U, and therefore the floor 8, with its load to expose the floor 7 of the lower compartment 6L. This provides for an earth collection space 10 between the lower floor 7 and the upper floor 8.

In addition, as can be seen in the illustrated embodiments, the upper floor 6U has also moved rearwardly e.g. toward the rear end of the scraper 1. As a result, the weight of the earth on the upper floor 6U is redistributed across the scraper 1 e.g. to be closer to, and preferably above, the wheels 17. This may reduce the weight applied to the draw bar and/or forces on the drive shaft.

Yet a further advantage of this arrangement may be that it can improve dumping of the earth from the upper floor 8. For instance, it may provide clearance between the upper compartment 6U and the apron and/r or cause the earth to spill over the draw bar.

As the scraper 1 continues to scrape across the ground, new earth entering the container 6 collects on the lower floor 7 unimpeded by the earth that was collected previously and is now sitting, elevated, on the upper floor 8. In the illustrated embodiment, the actuator 39 is in the form of a hydraulic cylinder and ram as should be known to one skilled in the art, and reference will be made as such.

However, in other embodiments the actuator 39 may take other forms or include an alternative lifting mechanism, for example a cable and winch, etc.

As indicated in FIG. 3, the two compartments 6L, 6U are connected by at least one strut 11 e.g. preferably two struts 11 as illustrated, spaced from one another at each side of the container. Each strut 11 has a pivot connection 12 at each end and it is by these that the struts engage the floors. The arrangement enables the upper compartment to swing through an arcuate path from a lowered positioned to a raised positioned from the lower compartment. The container 6 is structured such that the upper compartment 6U is substantially inside the lower compartment 6L until it is elevated.

Figure 4:
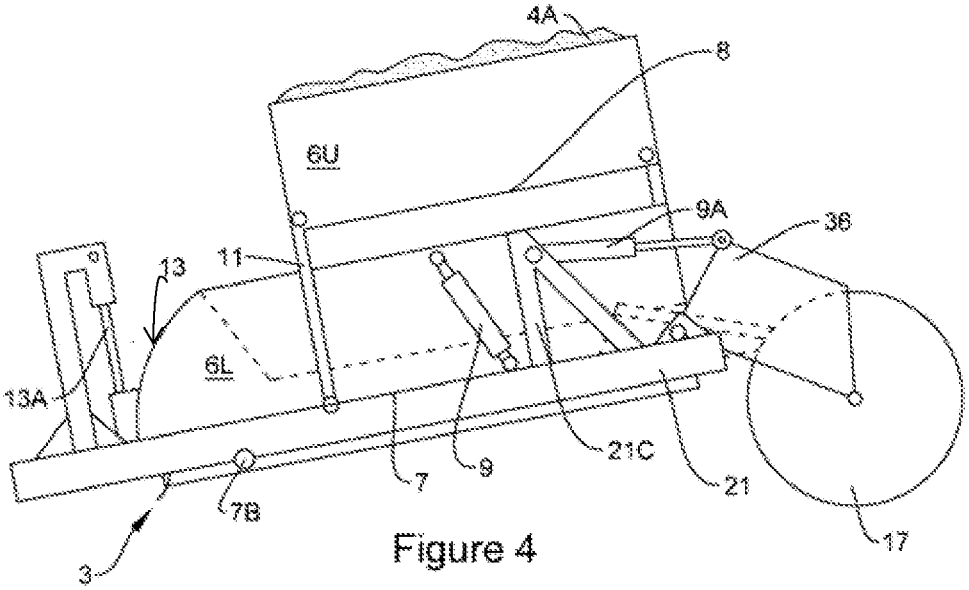
FIG. 4 is a side view illustrating the scraper when the upper compartment is both elevated and tipped slightly forwards and downwards due to the scraper wheels being lowered.

Referring to FIG. 4, when both the upper and lower floors are sufficiently filled with earth, the blade 3 is mechanically raised out of the ground and the entrance to the container is closed. A barrier, for example an apron 13, is lowered to prevent earth falling out of the front of the scraper 1 as it is transported to the place where it is to be dumped. The apron 13 can be lowered and raised as desired by an actuator e.g. a hydraulic cylinder and ram 13*a* as illustrated.

An actuator e.g. a hydraulic cylinder and ram 9*a* as illustrated, is provided to move the scraper from a 'scraping mode' being a configuration in which it can cut earth to a lifted configuration. In the scraping mode, the blade 3 is in contact with the ground over which the scraper 1 is moved. In the illustrated embodiment, the ram 9*a* is pivotally fixed to a bracket 36 holding the drive wheels at one end, and pivotally fixed to an upright beam 21*c* at a central part of the main structural frame 21 at its other end. The arrangement is replicated on the opposite side of the scraper 1.

Extension of the ram 9*a* moves the scraper 1 to a 'lifted disposition' being a configuration in which it can be transported (as per FIG. 4) or stored. Contraction of the ram 9*a* lowers the scraper into the 'scraping mode' where the blade 3 can reach and cut into the earth (as per FIG. 3).

Figure 5:
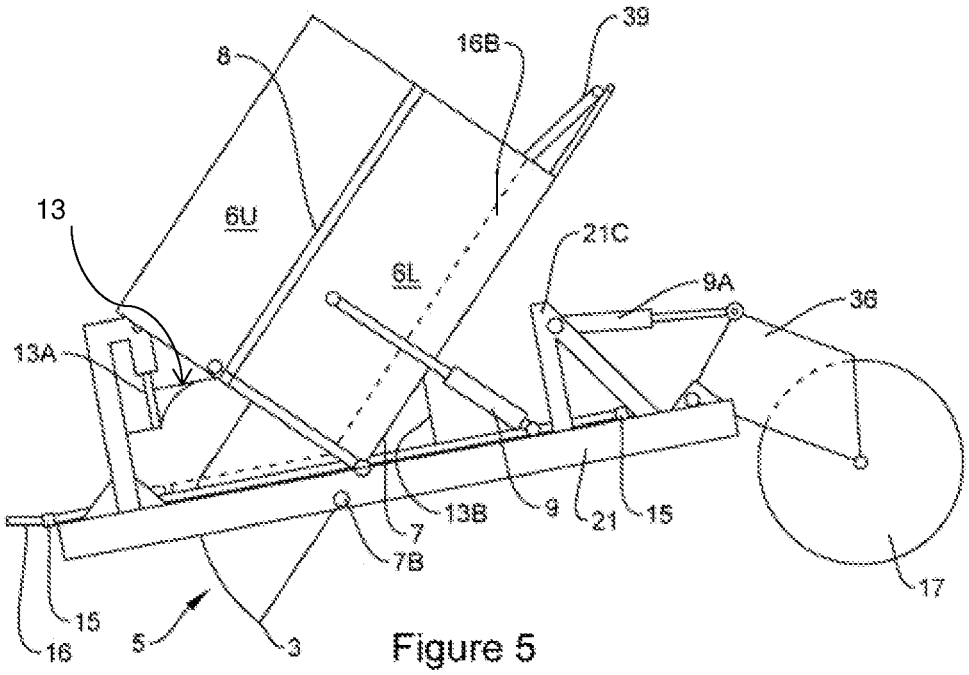
FIG. 5 is a side view illustrating the scraper when the upper compartment is both elevated and substantially tipped forwards for unloading its contents.

FIG. 5 illustrates the container 6 tipped up in the manner described above, but to a much greater degree, and with the apron 13 opened. This enables earth to slide off the top floor 8 onto the lower floor 7, or onto the earth that is already on the lower floor 7, and then to slide off the lower floor 7 via the entrance 5 (which in this instance functions as an exit).

Figure 6:
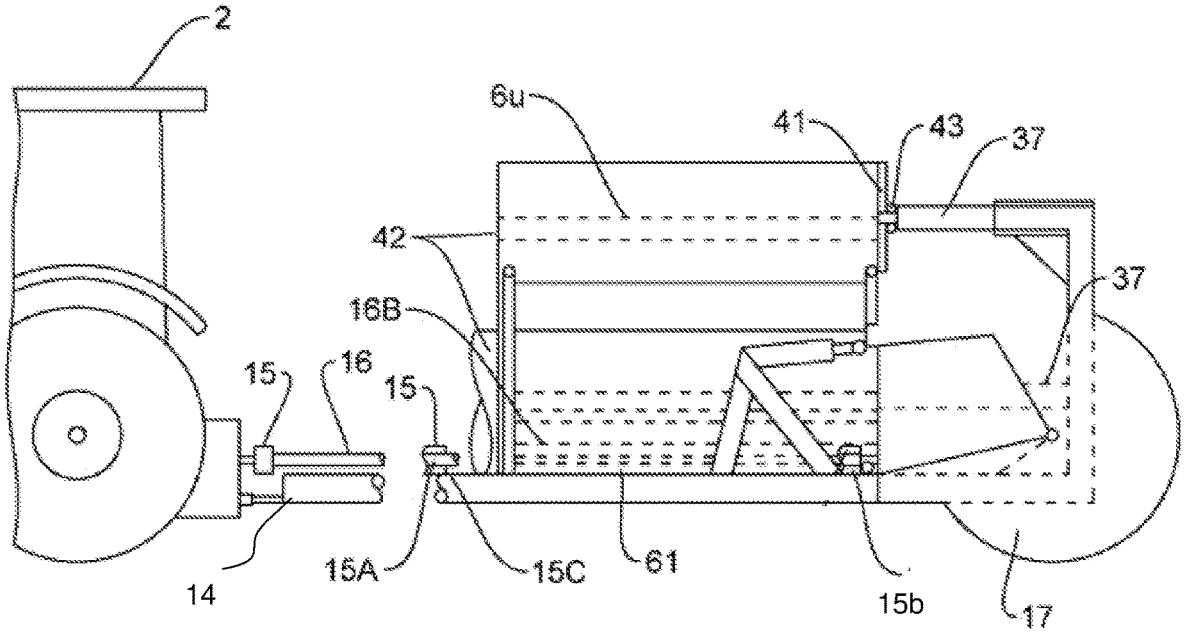
FIG. 6 is a side view of a similar but alternative embodiment of the scraper where its upper and lower compartments each have an ejector.
Figure 7:
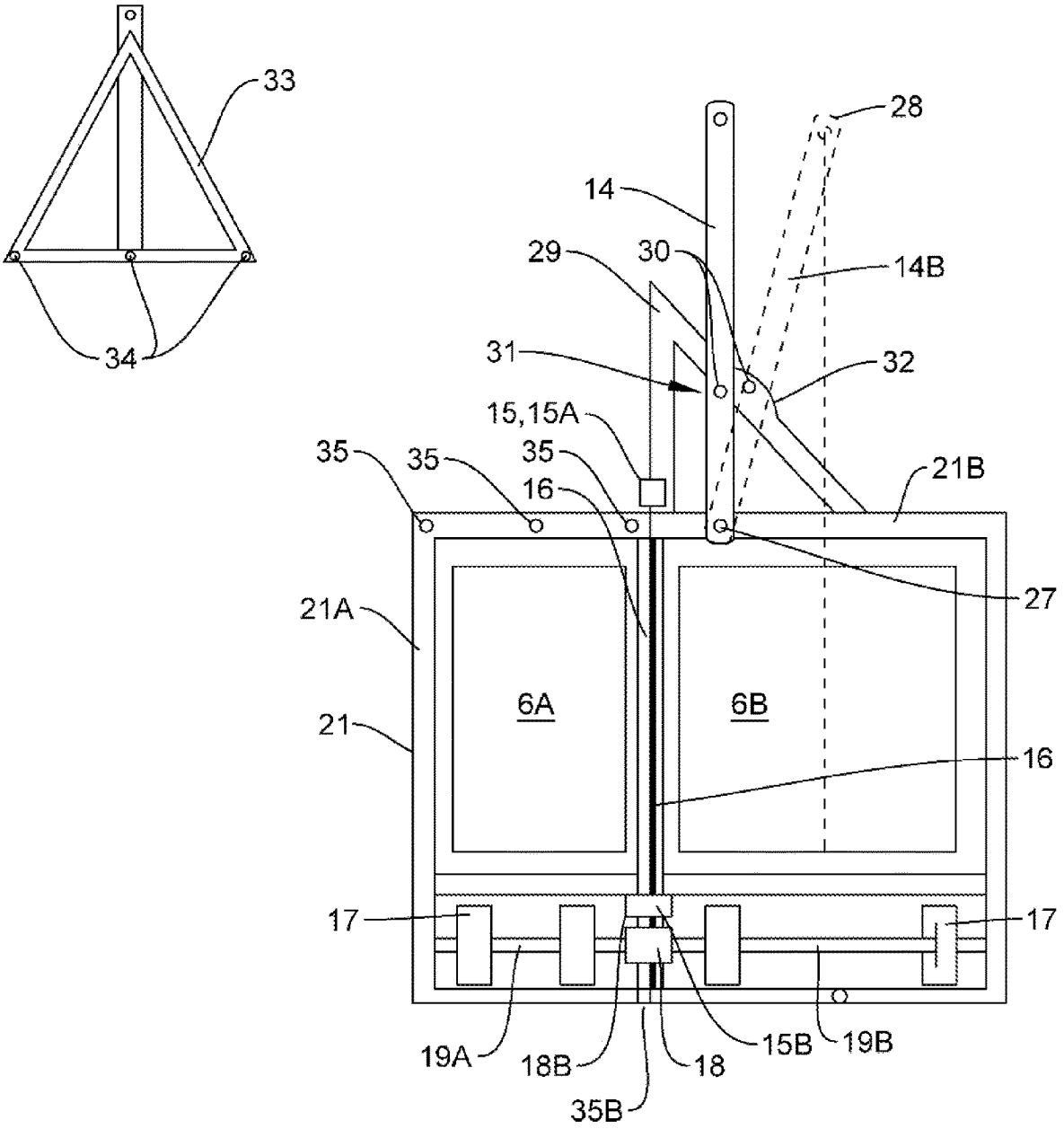
FIG. 7 is a schematic plan view showing power transfer and coupling details for scrapers the same or similar to any of those described above.

Referring to FIGS. 6 and 7, the front of the scraper 1 has a draw bar 14 for securing it to the rear of the tractor unit 2. In preferred embodiments there is also a universal joint 15 just above the draw bar and connected to a rotating drive shaft 16 forming part of the scraper 1. The drive shaft 16 extends through the centre of the scraper and is used to transfer force from the tractor unit, via the universal joint 15, to drive the scraper's wheels 17. There is also a universal joint 15*a* located in front of the scraper blade 3 and another universal joint 15*b* at the rear of the scraper frame 21. The drive shaft next to the universal joints 15*a*, 15*b* is supported by bearings in pillow blocks 15*c* fixed to the main frame 21. In this embodiment the scraper 1 has an ejector 41 which serves to help push earth out of the container 6 when it needs to be dumped.

As shown, the container 6 may be split into two structure indicated as 6A and 6B, which define a space (not marked) in which the drive shaft 16 is positioned e.g. between the structures 6A, 6B. The structure may be considered to be buckets or pans, or other structures to receive and hold earth scraped by the scraper 1. In some embodiments, the scraper 1 may have, instead of or in addition to a tilt mechanism, piston based ejectors 37 (see FIG. 6) that can move generally horizontally to push the earth from the container compartments 6U, 6L for dumping it.

Referring especially to FIG. 7, the rear end of the drive shaft 16 connects to a differential 18 that is in turn connected to an axle comprising sub-axels 19*a*, 19*b*, one either side. Rotational movement of the drive shaft 16 transfers through the differential 18 to the axle and then to the wheels 17 to drive them and help keep the scraper moving efficiently. The outer right wheel 17 of pan 6B may include a coupling that enables that wheel to detach t from the drive shaft 16 to allow it to 'free-wheel' for road transport.

Referring back to FIG. 5, the floor 7 of the lower compartment 6L has a central raised section, e.g. a tunnel 16B, to accommodate the drive shaft 16. This enables the drive shaft to be positioned higher than the lowest point of the lower compartment, but clear of contact with that compartment. The arrangement enables the size of the lower compartment 6L to be maximised without requiring it to sit higher, i.e. all above the drive shaft. When the container tips as shown in FIG. 5, it pivots on pivot links 7B at the main frame 21. Only one of the pivot links 7B is shown in the drawing but there will be another at the opposite side of the container. To prevent the lower floor 7 of the lower compartment 6L hitting the drive shaft 16 during such pivoting, the tunnel 16B may have a higher portion (e.g. a larger hump) forward of the pivot links 7B.

Referring to FIG. 6, the scraper may have an earth load ejector 37 for at least one of the upper compartment 6U and the lower compartment 6L. More specifically, for each ejector 37 the back walls 41 of the compartments 6U, 6L are able to slide in horizontal grooves between each compartment's side walls 42. To remove earth from the upper compartment 6U and/or lower compartment 6L the ejector 37 pushes the respective back wall 41 forward in turn. As a result the earth in the upper compartment 6U earth falls to the lower compartment 6L. From there the earth is moved to and out of an opening generally above the blade 3. The lower ejector 37 then retracts with its associated back wall 41 to make space for a new load of earth. To lower the top compartment 6U down to receive earth, its associated ejector 37 piston is first disengaged from the corresponding back wall 41 utilising a solenoid operated catch 43. The catch attaches to the back wall to the ejector 37 when the upper compartment is lifted up to its transport position. The back wall of the lower compartment 6L can be permanently attached to its associated ejector 37.

In some embodiments an over-run clutch and reduction box 18B (see FIG. 7) may be included between the drive shaft and the differential. The clutch serves to prevent the drive shaft 16 from spinning when it is not receiving power from the tractor but the scraper is nonetheless being towed. The reduction box may be customised with gearing so that the distance travelled by the scraper's wheels when urged along by the drive shaft 16 is substantially similar to the distance covered by the tractor wheels. Optionally, as an alternative to the reduction box, a belt and pulley system or a chain on sprockets, with different sized pulleys or sprockets on the and output shafts, may be used to achieve a similar result.

Sub-Frames and Adjustable Draw Bar

Referring further to FIG. 7, the main structural frame 21 may be made up of two sub frames 21*a*, 21*b*, each supporting a different one of the pans 6A, 6B respectively. Each pan may have an upper compartment and a lower compartment as described previously. In this example the pan 6A on the left is smaller than the pan 6B on the right.

Still with FIG. 7, the left-hand sub-frame 21A with its associated pan 6A can be detached from the other sub-frame to make the scraper narrower for road transport, for example to fit within a normal traffic lane on a highway. To facilitate this the front section of the drive shaft 16 may be removed forward of the associated pillow block 15*c* at the front of the sub-frame 21B. But when the scraper is used on a work site the two sub-frames, including their pans, are reattached to give the scraper a greater reach across the earth when scraping. In this embodiment the blade 3 comprises sub-blades, one with each of the sub-frames.

When the scraper is in scraping mode, the draw bar 14 is centred, or in other words is located half way across the width of container 6. In this position draw bar 14 is to the right of the point where the sub-frames meet because the left sub-frame 21*a* is smaller than the right sub-frame 21*b*. But when the scraper is in road transport mode with the left-hand sub-frame 21*a* detached, the draw bar has to be adjusted because it will no longer be centred for towing the scraper. The adjustment involves pivoting the drawbar about a pivot connection 27 to the position indicated by broken lines 14*b*. In that position the distil end 28 of the draw bar is in line with the centre of the right-hand sub-frame 21*b*.

As illustrated the right-hand sub-frame 21*b* has an angular forward hitch frame 29 that accommodates locking of the draw bar 14 when in road transport mode, and also when in scraping mode. In either case the draw bar 14 is secured to the hitch frame 29 by way of a locking pin 30 that passes through aligned apertures in both parts. When the draw bar 14 is in its scraping mode disposition the locking pin 30 passes through an aperture 31 of the hitch bar directly in front of the pivot connection 27. But when in its road transport mode disposition the locking pin 30 passes through an aperture 32 of the hitch bar that is to the right hand side of the pivot connection 27.

When the smaller left hand sub-frame 21*a* is detached at 35 and 35B it can be towed for road transport, by way of a triangular hitch 33 The hitch 33 has apertures 34 that can be aligned with apertures 35 of the sub-frame 21A for receiving locking bolts. Sub-frame 21B (and therefore the pan 6A) can therefore be towed behind sub-frame 21B (and therefore the pan 6B).

Figure 8:
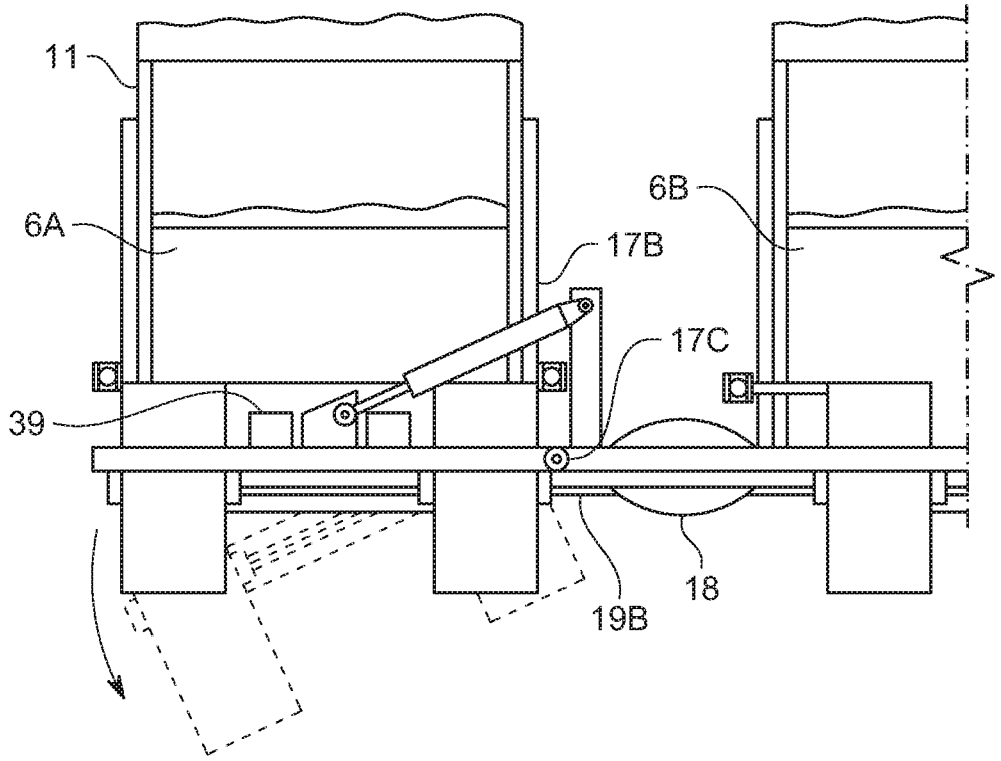
FIG. 8 is a schematic rear view of the FIG. 7 scraper showing detail relating to the transfer of power to the wheels.

Referring to FIG. 8, the sub-frame of the pan 6A may be rigidly bolted to the sub-frame of the pan 6B, keeping both sub-frames substantially horizontal and parallel to one other.

Alternatively, the sub-frame of pan 6A may be pivotable at a pivot point 17*c*. This enables pivoting movement between the pans 6A, 6B to increase the central ground clearance where the pans 6A, 6B meet. This also serves to lower the center of gravity of the smaller pan 6A by allowing it to follow the contour of the underlying ground instead of being cantilevered into the air (i.e. with the underlying wheels 17 lifting off the ground) when the wheels under the larger heavier pan 6B are relatively lower point to the ground transversally opposite to pan 6A.

A linear actuator 17B (optionally a ram) can be used to alter the angle of the pan 6A relative to the pan 6B to enhance operational capability. The actuator tilts the pan 6A down relative to pan 6B when horizontal. The dotted lines show the pan 6A when angled down relative to the pan 6B. Pivoting between the pans 6A, 6B at point 17C may be assisted by actuators e.g. hydraulic cylinders and rams. Or other forms of actuators.

FIG. 9 illustrates an alternative way of lifting the upper compartment 6U. In this example there is a ram 9*b* pivotally connected at one end to the frame 21 at about the level of the lower floor 7, and pivotally connected to the container's upper compartment at its other end. When the ram 9*b* extends, it causes the upper compartment 6U to swing upwards (as shown in broken lines) about a pivot connection 12*a* at an upright support at the rear wall of the lower compartment 6L. Therefore, when the upper compartment 6U is filled with soil it can be swung upwards to make room for new soil to collect in the lower compartment 6L. The soil is dumped when both compartments are lifted up and tilted forward, for example in similar manner to that described for FIG. 5. In other words, the ram 9 pivots at one end so that the compartments tilt forward on the frame 21. When the soil is emptied, the upper compartment can swing back down to stow within the lower compartment so that the upper floor 7 and the lower floor 8 are substantially flat packed.

Alternate Embodiment

Referring now to FIGS. 17 to 19 which illustrate an alternate embodiment of a scraper 2A according to an aspect of the technology. Like references refer to like components.

As can be seen, the actuator 39 extends rearwardly and is connected to the upper compartment 6U by a linkage (indicated generally as 50). In addition, the actuator 39 is pivotally mounted to the lower compartment 6L e.g. to the backwall 37.

The linkage 50 includes a first arm 52 and a second arm 54 which are pivotally attached to each other. First arm 52 is pivotally attached to the upper compartment 6U and the second arm 54 is pivotally attached to the lower compartment 6L e.g. the backwall 37.

In use, extension of the actuator 39 is transferred to the upper compartment 6U by the linkage, causing the upper compartment 6U to move upwards and rearwardly e.g. to the position shown in FIG. 18. The actuator 39 can subsequently be contracted to move the upper compartment 6U downwardly and forwardly e.g. to the position shown in FIG. 17.

To dump earth from the compartments 6U, 6L, the actuator 39 is extended. This causes the compartments to tilt with respect to the support frame 21 e.g. to assume the position illustrated in FIG. 19.

The embodiment of FIGS. 17 to 19 may provide advantages in addition or alternative to the advantages described with reference to the other embodiments. For instance, these may include one or more of:

- Increasing the lifting force provided by the actuator 39 by utilising its extension action to drive the lifting action;
- Facilitating a relatively higher connection between the upper compartment 6U and 6L i.e. the point at which arm 54 is pivotally attached to the rear wall 37 can be relatively higher. This may in turn provide increased clearance between the upper compartment 6U and the lower compartment 6L as the upper compartment 6U moves between the lowered and elevated positions;
- Reduces potential damage to the linkage 50 in use e.g. by loose earth or other material affecting the pivotal connection(s).

Accumulator Features

Hydraulic power may be used to raise the upper compartment. This may require substantial energy to be drawn from the tractor unit 2, which in some instances may at least periodically compromise its ability to tow the scraper 1 when the blade 3 is working against the earth. To address this, in some embodiments of the invention the scraper may have a hydraulic accumulator. This receives energy from the tractor unit when the scraper is not scraping, and stores the energy for future use to raise the upper compartment.

FIG. 10 illustrates a preferred layout for the scraper having its main structural frame 21 extending around the container pan 6*a* (a similar arrangement may be used for the other pan 6*b*). A delivery line 22 moves hydraulic fluid from the tractor unit to an accumulator 23. The fluid is highly pressurised in the accumulator and then moves along a transfer line 24 to an intensifier 25 where the pressure of the fluid is increased. The pressurised hydraulic fluid then exits the system shown via an outlet line 22*a*. When needed, nitrogen gas is supplied to the accumulator 23 from a gas chamber 26 which is in turn supplied via a gas line 27. The gas is used for pressurising hydraulic fluid in the accumulator 23. As will be appreciated, movement of the hydraulic fluid and the gas is controlled by the use of appropriately placed valves.

FIG. 11 shows more detail of the accumulator 23. It comprises a chamber 28 for holding the hydraulic fluid, together with a bladder 29 charged with nitrogen gas from the gas chamber 26 via the gas line 27. The hydraulic fluid is forced into the accumulator's chamber 28 to compress the bladder, or more particularly to compress the gas within the bladder. When power is needed to supplement the tractor's hydraulic system to raise the upper compartment, the pressurised hydraulic fluid is released from the accumulator and directed towards the rams 39 to drive them to lift the upper compartment. As this happens the bladder, including the gas within it, expands, ready to be compressed again when the tractor unit has sufficient spare power.

As shown, the bladder 29 is generally cylindrical or elliptical. When under compression it is as shown, i.e. generally flattened with tightly curved ends 30. When not under compression it assumes a more rounded state.

According to a further embodiment of the invention the accumulator 23 may be as shown in FIG. 12, namely the same as above but with a porous, sieve-like or otherwise permeable internal barrier 31. This prevents the bladder 29 being drawn to the hydraulic fluid outlet on the other side of the barrier 31 when the fluid is moving under pressure out of the accumulator. In other words, the hydraulic fluid can move through the barrier 31, but the bladder cannot.

While it is not essential, the accumulator may be generally in the form of rectangular prism, i.e. so that it can more easily form a part of the scraper's main structural frame 21. However, in other embodiments the rectangular prism shape may be modified to be cylindrical with hemispherical ends.

The fact that the intensifier compartment 23, accumulator 25 and gas chamber 26 form part of the scraper's structural frame 21, assists in keeping the weight and size of the scraper down. It may also facilitate savings in production costs.

FIG. 13 provides overhead plan detail of an optional mechanism for moving the upper compartment of the container for the above scrapers. In order to show relevant parts more clearly, the upper floor 8 has been omitted from the drawing. There are four of the struts 11 for holding the upper floor in an elevated disposition, each of these struts 11 at the front being positioned between the outer side of the wall of the lower compartment 6L and the main structural frame 21. The struts 11 that are at the rear are within floor extensions of the upper and lower compartments 6L, 6U and have pivot connections at each end joining them to the upper and lower compartments so that the struts can pivot to raise the upper compartment and then pivot to bring the upper compartment down to the lower compartment's floor 7. More specifically, floor extensions are behind the back walls of the upper and lower compartments 6L, 6U.

Figure 13A:
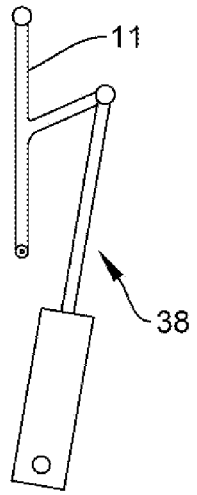

The FIG. 13 scraper has a crank mechanism 38 at each side, shown in side view in FIG. 13A. Each crank mechanism has a ram 39 pivotally mounted to an extension 7*a* of the lower floor 7 at one end, and pivotally mounted to a rotating cross shaft 40 at the other end. When the rams 39 contract they force the upper compartment 6U into its elevated disposition.

More particularly, the FIG. 13 embodiment has a crank mechanism 38 at each side as shown in side view in FIG. 13A. The crank mechanisms 38 are connected by the cross shaft 40. Inboard of the crank mechanisms 38, the cross shaft connects to linear actuators or to the cabling of a winch or winches. For the shaft 40 to rotate, it pivots in clevis ends of the crank mechanisms 38 and, if linear actuators are used, it pivots in the clevis ends of the actuators. At the opposite ends the actuators pivot into a clevis arrangement at extensions of the lower floor 7*a*. When the actuators contract, they pull back on the cross shaft 40, which in turn pulls back on the crank mechanisms which, being attached to struts, raise the upper compartment 6U to its elevated position. Due to the parallelogram lifting mechanism shown, the initial force to lift a load is higher than the force required in that later part of the lift.

FIG. 14 shows the FIG. 13 scraper with its upper compartment 6U elevated. As indicated, the struts 11*a* at the rear end of the frame 21 may be in the form of triangular plates. Each plate 11*a* is pivotally connected between the ram that moves it up and down between the upper and lower floors. There is one plate 11*a* at each rear corner of the container. In some embodiments the rams 39 may be arranged inside the side walls of the container, making more space for the scraper's wheels 17 to be outside the container. This assists in providing a low centre of gravity for the scraper.

FIG. 15 illustrates the manner in which the bottom floor 7 and top floor 8 are arranged in respect of the draft shaft 16 and the complementary tunnel 16C. As will be appreciated, the top floor 8 also has a tunnel shape 16B so that when in its initially lowered position it does not undesirably clash with the tunnel 16C of the lower floor 7. The scraper blade 3 may be bolted to the lower floor 7 sufficiently below the drive shaft 16 so that the two do not clash when the container tips to release its load. Preferably the blade 3 extends substantially the full width of the lower floor 7 to enhance the rigidity of the floor.

For flat packing the floors 7, 8 for transporting the scraper by road when not loaded, and also for ease of fabrication, the lower transmission tunnel 16C may be a separable part of the lower floor 7. Optionally the upwardly extending sides of the tunnel 16C are formed from plate steel and are secured to the rest of the floor 7 by bolts 16F that extend through beams 16E running in the longitudinal dimension of the scraper i.e. running into the page in the drawing. In some embodiments the tunnel 16B may be similarly separable from the rest of the upper floor 8 by way of bolts.

FIG. 16 illustrates further detail of optional features for implementing the scraper. In this regard a rear cross shaft 36B (also shown in FIG. 2) is mounted to and extends between the wheel brackets 36 (see FIG. 4), and can be used to transfer power for lifting and lowering the apron 13 (not shown) at the front of the scraper. In particular, the power may be transferred to the apron lifter mechanism 13A by way of tensioned cabling 36F running along the drive shaft's tunnel 16B.

More specifically, a rod 36C has a clevis at both ends. At one end the rod 36C pivots on the midpoint of the cross shaft 36B by way of the clevis, and at the other end it connects by way of the clevis to a hole in the end of a bar 36D. More specifically, at one end the rod 36C has a clevis, and a pin passes through the clevis so that the rod 36C joins to a bracket on the midpoint of the cross shaft 36B. The other end of the rod 36C connects to a bar 36D by way of the other clevis, by way of a pin that engages a hole in the end of that bar. The bar 36D has a hole between the upper and lower ends, optionally about mid way along the bar. A pin passes through the hole and the bar 36D pivots on that bin so it can tilt forwards and backwards. When the bar 36D moves forwards at the top (to the right), its lower end moves backwards (to the right) to pull on and put tension on the cabling 36F to lift the apron 13 (not shown). Preferably the cabling 36F is attached to the lower end of the bar 36D and, after passing through the transmission tunnel 16B, proceeds over a sheave block on the lifting mechanism 13A to provide lifting force for the apron 13.

Still with FIG. 16, the main frame 21 (not shown) may be lowered on the wheels 17 (not shown) by way of a ram 9A. In this regard when the ram 9A retracts, it pulls the wheel plates 36 forward (to the left in the drawing) which causes the rod 36C to push forward on the bar 36D. This lowering brings the blade 3 into contact with the ground for scraping.

Referring back to FIG. 5, a cable 13B attached to the underside of the bottom floor 7 may be sheaved back to the main frame 21 and then extend through to the apron 13. When the floor 7 pivots to the dump position the cabling tightens, thereby lifting the apron 13 to allow the load to be dumped.

As will be appreciated, using the tunnel 16B as a housing for power transmission components, means that items such as cabling or hydraulic hosing do not need to be threaded around the side or above the main structure of the scraper. Further, cabling or hydraulic hose also can be used to transmit force from the cross shaft 36B, for lifting and lowering a front set of earth rippers (not shown).

In yet other embodiments the scrapers above may have the drive shaft 16 contained within a longitudinal hollow structural section of the main structural frame 21. This may be implemented in the manner of a transmission tunnel but to minimise the height of the bump described above and provide a safety shield around the drive shaft 16.

While some forms of the invention have been described by way of example, it should be appreciated that modifications and improvements can be made without departing from the scope of the following claims.

In terms of disclosure, this document envisages and hereby posits any feature mentioned herein in combination with itself or any other feature or features mentioned herein, even if the combination is not claimed.

The invention claimed is:

1. A scraper comprising a container assembly, a lifter, a blade, and a ground engaging component configured to facilitate movement of the scraper over the ground, the container assembly having a lower compartment having a floor and an upper compartment having a floor, wherein the upper compartment is arranged to lay within the lower compartment, and wherein the scraper is formed such that:

the blade is arranged to scrape earth from the ground so the earth moves into the container assembly and into the upper compartment; and wherein the lifter comprises a parallelogram linkage configured to move the upper compartment upwardly and rearwardly to create a space between the floor of the upper compartment and the floor of the lower compartment, such that further earth scraped by the scraper enters that space and is retained in the lower compartment; and wherein the upward and rearward movement of the upper compartment positions at least a portion of the upper compartment above the at least one ground engaging component, and wherein the respective floors of the upper compartment and the lower compartment remain substantially parallel to each other during the upward and rearward movement of the upper compartment.

2. The scraper according to claim 1, comprising a series of struts arranged to swing the upper compartment upwardly and rearwardly to create the space between the floor of the upper compartment and the floor of the lower compartment.

3. The scraper as claimed in claim 1, further comprising a drive shaft adapted to be coupled to and given rotational motion by a towing vehicle to drive the ground engaging component and, as a consequence the scraper, over the ground while the blade scrapes the earth into the container assembly.

4. The scraper according to claim 3, wherein the ground engaging component comprises at least a pair of ground engaging wheels or tracks that enable the scraper to be towed.

5. The scraper according to claim 3, wherein the upper compartment and lower compartment comprises subdivisions or separated pans.

6. The scraper according to claim 5, wherein the drive shaft extends along a space between the pans.

7. The scraper according to claim 3, wherein the drive shaft is coupled to a differential, which is in turn connected to an axle, the axle in turn being connected to the ground engaging component for facilitating towing of the scraper.

8. The scraper according to claim 7, wherein the axle comprises two sub axles, one either side of the differential.

9. The scraper according to claim 3, wherein the blade comprises separate sub-blades.

10. The scraper according to claim 1, comprising a structural frame supporting the container assembly.

11. The scraper according to claim 10, wherein the structural frame comprises detachable sub-frames.

12. The scraper according to claim 11, comprising a draw bar adapted to swing about a pivot connection so that a distal end of the draw bar can be aligned with the centre of the combination of the sub-frames when the sub-frames are attached to one another, and subsequently aligned with the centre of one of the sub frames that it swings about when the sub-frames are detached from one another.

13. The scraper according to claim 1, comprising an accumulator that stores energy from a tractor unit and uses that energy to at least assist in raising the upper compartment when laden with scraped earth.

14. The scraper according to claim 13, wherein the accumulator is built into a structural frame that supports the container assembly or a pan thereof.

15. The scraper according to claim 13, wherein the accumulator comprises a gas filled bladder adapted to be compressed by hydraulic fluid for storing energy, and subsequently decompressed to release energy.

16. The scraper according to claim 15, wherein the accumulator has an internal compartment housing the bladder, hydraulic fluid and an outlet for the fluid when under pressure, the bladder being separated from the outlet by a permeable barrier.

17. The scraper according to claim 3 wherein the drive shaft extends within a raised section of the lower compartment and is higher than the lowermost interior surface of that compartment.

18. The scraper according to claim 1, wherein the lifter comprises a support frame and at least one ground engaging component.

19. The scraper according to claim 18, wherein the parallelogram linkage mounts the upper compartment to floor to a/the support frame.

20. The scraper according to claim 19, wherein the lifter further comprises an actuator configured to provide a driving force to move the upper compartment between an elevated position and a lowered position.

21. The scraper according to claim 20, wherein the actuator comprises at least one hydraulic cylinder and ram.

* * * * *